US005784243A

United States Patent [19]

Pollman et al.

[11] Patent Number: 5,784,243

[45] Date of Patent: Jul. 21, 1998

[54] MODULAR ACCESSORY MECHANICAL LOOK-OUT MECHANISM

[75] Inventors: John A. Pollman, Seymour; Raymond K. Seymour, Plainville, both of Conn.

[73] Assignee: General Electric Company, New York, N.Y.

[21] Appl. No.: 796,329

[22] Filed: Feb. 7, 1997

[51] Int. Cl.[6] ..... H01H 73/00

[52] U.S. Cl. ..... 361/115; 335/174

[58] Field of Search ..... 361/170, 187, 361/102, 115, 192; 200/400; 335/167, 171, 172, 176, 174

[56] References Cited

U.S. PATENT DOCUMENTS

| | | | |
|---|---|---|---|
| 3,703,691 | 11/1972 | Gryctko et al. | 335/20 |
| 4,001,739 | 1/1977 | Powell et al. | 335/34 |
| 4,301,434 | 11/1981 | Castonguay | 335/20 |
| 4,672,501 | 6/1987 | Bilac et al. | 361/96 |
| 4,700,161 | 10/1987 | Todaro et al. | 335/172 |
| 5,117,210 | 5/1992 | Castonguay et al. | 335/172 |
| 5,153,544 | 10/1992 | Castonguay et al. | 335/167 |
| 5,424,701 | 6/1995 | Castonguay et al. | 335/172 |
| 5,486,667 | 1/1996 | Castonguay et al. | 200/400 |
| 5,488,211 | 1/1996 | Castonguay et al. | 200/400 |
| 5,489,755 | 2/1996 | Castonguay et al. | 200/400 |
| 5,502,286 | 3/1996 | Pollman et al. | 200/401 |
| 5,521,346 | 5/1996 | Castonguay et al. | 200/401 |
| 5,605,224 | 2/1997 | Seymour et al. | 200/401 |
| 5,631,798 | 5/1997 | Seymour et al. | 361/102 |

*Primary Examiner*—Jeffrey A. Gaffin
*Assistant Examiner*—Michael J. Sherry
*Attorney, Agent, or Firm*—Richard A. Menelly; Carl B. Horton

[57] ABSTRACT

A lockout solenoid is connected with the circuit breaker accessory shunt trip in a high ampere rated circuit breaker and interacts with the circuit breaker accessory lever to prevent the closing of the circuit breaker contacts until the shunt trip activation voltage signal is turned off. The circuit breaker accessory lever interlocks the circuit breaker closing button to prevent closing the circuit breaker contacts until such shunt trip activation voltage signal is turned off.

12 Claims, 4 Drawing Sheets

10

MODULAR ACCESSORY MECHANICAL LOOK-OUT MECHANISM

BACKGROUND OF THE INVENTION

U.S. Pat. No. 5,488,211 entitled "Latching Arrangement for High Ampere-Rated Circuit Breaker Operating Springs" describes a combined bell alarm-lockout accessory that is connected with the electronic trip unit that controls a high ampere rated circuit breaker. The accessory interacts with the circuit breaker operating mechanism to activate the bell alarm upon circuit interruption and to prevent the closing of the circuit breaker contacts until the accessory is manually reset. U.S. Pat. No. 5,605,224 entitled "Accessory Compartment for High Ampere-Rated Circuit Breaker" relates to a high ampere-rated circuit breaker that meets the electrical code requirements of the world market. The circuit breaker electronic trip unit is contained within a recess in the circuit breaker cover and is interlocked with the circuit breaker operating mechanism to articulate the operating mechanism upon removal. The accessory units are contained within an adjoining accessory compartment recess within the circuit breaker cover.

U.S. Pat. No. 5,502,286 entitled "Bell Alarm and Lock-out for High Ampere-Rated Circuit Breakers" describes a combined bell alarm-lockout accessory that is connected with the electronic trip unit that controls a high ampere rated circuit breaker. The accessory interacts with the circuit breaker operating mechanism to activate the bell alarm upon circuit interruption and to prevent the closing of the circuit breaker contacts until the accessory is manually reset.

U.S. Pat. No. 5,521,346 entitled "Sequential Close Interlock Arrangement for High Ampere-Rated Circuit Breaker" relates to a high ampere-rated circuit breaker which meets the electrical code requirements of the world market. The charging of the powerful operating springs controlling the circuit breaker contacts is made manually by means of a ratchet and pawl assembly. A two stage latching arrangement controls the retention and release of the pawl to retain and discharge the operating springs. The latches are interlocked with the operating springs drive shaft to prevent the discharge of the operating springs when the contacts are in the closed condition.

When such accessories as described above are used within industrial applications, and have to be reset to insure future operation, it is desirable to insure that the associated circuit breaker contact closing springs are capable of being immediately reset. However, it is important that the circuit breaker contacts are not closed to turn on the circuit breaker unless and until the accessory has become reset and operational.

An early use of accessories within high ampere-rated circuit breakers is described within U.S. Pat. No. 4,001,739 entitled "Circuit Breaker With Bell Alarm and Breaker Lockout Accessory." The circuit breaker contacts are interlocked with the accessories by insuring that the circuit breaker contact springs cannot be reset until the associated accessory is reset, i.e. becomes operational.

U.S. Pat. No. 5,631,798 entitled "Modular Accessory Mechanical Lock-Out Mechanism" describes a lockout arrangement that includes a cut-out switch incorporated with the circuit breaker shunt trip unit to stop the tripping operation after the shunt trip has responded to separate the circuit breaker contacts. When the contacts are later closed, the cut-out switch is turned off and the state of the signal to the shunt trip determines whether the shunt trip operates to again separate the contacts. Should the shunt trip remain energized when the circuit breaker is caused to close, the operating mechanism immediately responds to again separate the contacts (but not before the main contacts close) in a manner described as "contact kissing". It has been determined that such opening and closing of the contacts could cause damage to the contacts and the operating mechanism, per se.

One purpose of the instant invention is to provide a circuit breaker lock-out mechanism that interacts with the circuit breaker closing button to prevent the circuit breaker contacts from being closed until and unless the voltage signal to the shunt trip is turned off.

SUMMARY OF THE INVENTION

A circuit breaker lock-out mechanism interfaces between the circuit closing button and the circuit breaker accessory lever to insure that the circuit breaker contacts remain open until the shunt trip is de-energized. A tab on the circuit breaker accessory lever contacts a surface on the spring-loaded accessory lever to prevent depression of the associated circuit breaker closing button until such shunt trip unit is de-energized

DESCRIPTION OF THE PREFERRED EMBODIMENT

Figure 1:
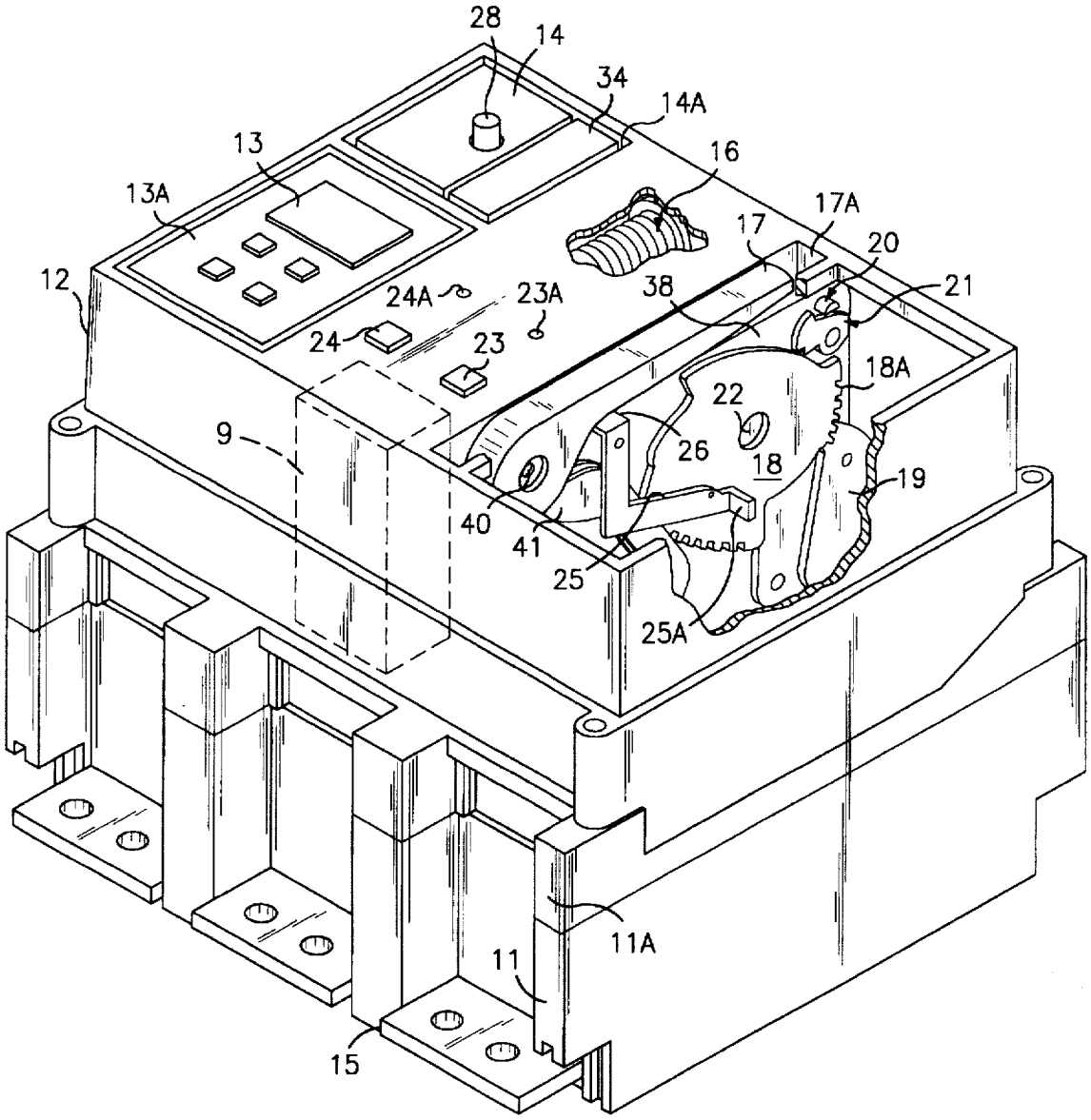
FIG. 1 is a top perspective view of a high ampere rated circuit breaker employing the circuit breaker lock-out mechanism according to the invention.

The high ampere-rated circuit breaker 10 shown in FIG. 1 is described in U.S. Pat. No. 5,424,701 entitled "Operating Mechanism for High Ampere-Rated Circuit Breakers" and is capable of transferring several thousand amperes quiescent circuit current at several hundred volts potential without overheating. The circuit breaker consists of an electrically insulated base 11 to which an intermediate cover 11A of similar insulative material is attached prior to attaching the top cover 12, also consisting of an electrically-insulative material. The operating mechanism 9 as described within tile aforementioned U.S. Pat. No. 5,424,701 controls the condition of the circuit breaker contacts. Electrical connection with the interior current-carrying components is made by load terminal straps 15 extending from one end of the base and line terminal straps (not shown) extending from the opposite end thereof. The interior components are controlled by an electronic trip unit 13 contained within a recess 13A on the top surface of the top cover 12. The trip unit 13 is similar to that described within U.S. Pat. No. 4,672,501 entitled "Circuit Breaker and Protective Relay Unit" and interacts further with the bell alarm lockout accessory 14 and the undervoltage release accessory 34 contained within the accessory recess 14A. A good description of these two accessories is found in aforementioned U.S. Pat. No. 5,631,798. The reset button 28 extending from the top of the bell alarm-lockout accessory serves to provide reset function to the accessory as well as indication as to whether the circuit breaker operating mechanism is operative. OPEN and CLOSE buttons 23, 24 and OPEN and CLOSE indicators 23A, 24A accessible from the top cover allow manual operation of the circuit breaker operating mechanism to separate the circuit breaker contacts. An operating handle 17 within the handle recess 17A allows the circuit breaker operating mechanism to be manually reset after automatic separation of the circuit breaker contacts. The reset button 28 on the top surface of the bell alarm-lockout accessory 14 allows the accessory to be reset.

Figure 2:
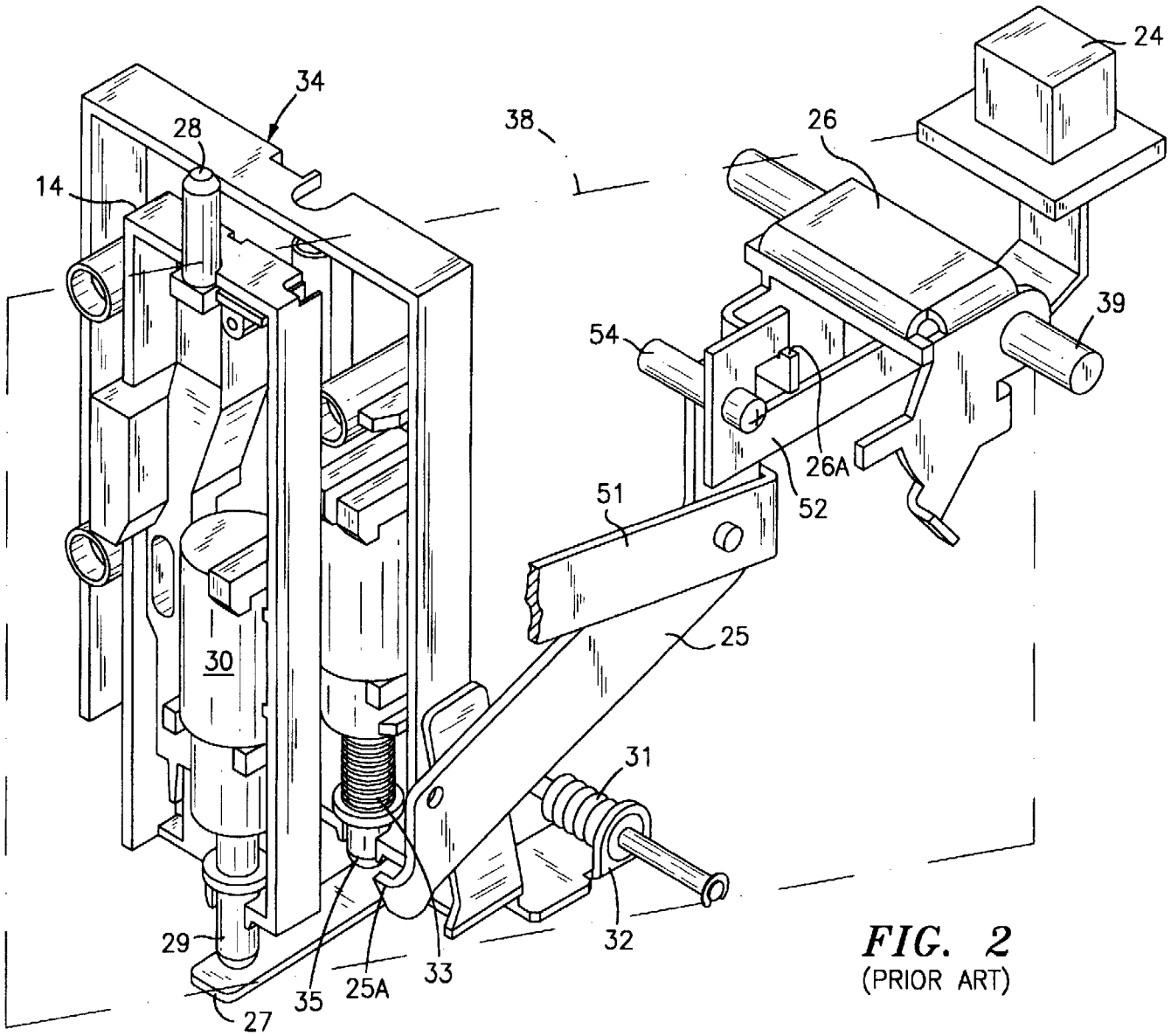
FIG. 2 (PRIOR ART)
FIG. 2 is an enlarged top perspective view of an accessories and lock-out mechanism within the circuit breaker of FIG. 1. in accordance with the prior art.

In the operating mechanism as described within U.S. Pat. No. 5,486,667 entitled "Rating Module Unit for High Ampere-Rated Circuit Breaker", the operating handle 17 allows manual operation of the circuit breaker operating mechanism 9 as well as providing manual means for charging the operating mechanism springs 16. The handle 17 is attached to the operating mechanism sideframe 38 by means of the handle pivot pin 40 and is connected with the handle drive gear 18 by a pair of handle drive links 41. The handle drive gear includes a series of handle drive teeth 18A that interact with a locking pawl 19 to restrain the handle drive gear from reverse rotation during the operating springs charging process as described in U.S. Pat. No. 5,489,755 entitled "Handle Operator Assembly for High Ampere-Rated Circuit Breaker" and with a two stage operating springs latching assembly consisting of the primary latch 20 and intermediate latch 21 to prevent rotation of the closing shaft 22 while the operating springs are being charged. The circuit breaker lock-out mechanism that prevents the circuit breaker operating springs 16 from being engaged in the CLOSE position until the bell alarm-lockout accessory 14 has been reset by means of the reset button 28 includes the interlock lever 25 that interacts with the CLOSE button 24 by means of the U-shaped piece 26 at one end and by means of the tab 25A (see FIG. 2) that interacts with the bell alarm-lockout accessory 14, trip lever 51 (see FIG. 2) and latch at the other end in the manner described within the aforementioned U.S. No. 5,631,798 is best seen by referring now to FIG. 2.

The interlock lever 25 is viewed from the inside of the circuit breaker 10 of FIG. 1 to detail the U-shaped piece 26 that interacts with the CLOSE button 24 of FIG. 1 by a button lever 52 that rotates about the pivot pin 54. The tab 26A rotates the interlock lever 25 and the trip lever 51 about the pivot 39. The interlock lever 25 attaches to the operating mechanism sideframe 38, shown in phantom, by means of the pivot pin 39. The bell alarm, reset button 28, bell alarm lockout accessory 14 and undervoltage release accessory 34 are shown relative to the interlock lever 25 to depict the accessory interlock function via the accessory lever 27. The position of the accessory lever is determined by the torsion return spring 31 arranged on the spring support 32, as indicated.

The bell alarm lockout accessory 14 is depicted with the reset button 28 extending from the top thereof and with the plunger 29 extending from the bottom. As described within the aforementioned U.S. Pat. No. 5,502,286, the position of the plunger 29 is set by the shunt trip 30 which responds to signals from the trip unit 13 (FIG. 1) to provide remote indication of the occurrence of a circuit interruption. The undervoltage release accessory 34 is similar to that described in U.S. Pat. No. 4,301,434 entitled "Undervoltage Release Reset and Lockout Apparatus" wherein a plunger 35 is withheld from extending by the solenoid 33 as long as the voltage applied to the solenoid is above a predetermined minimum value.

Figure 3:
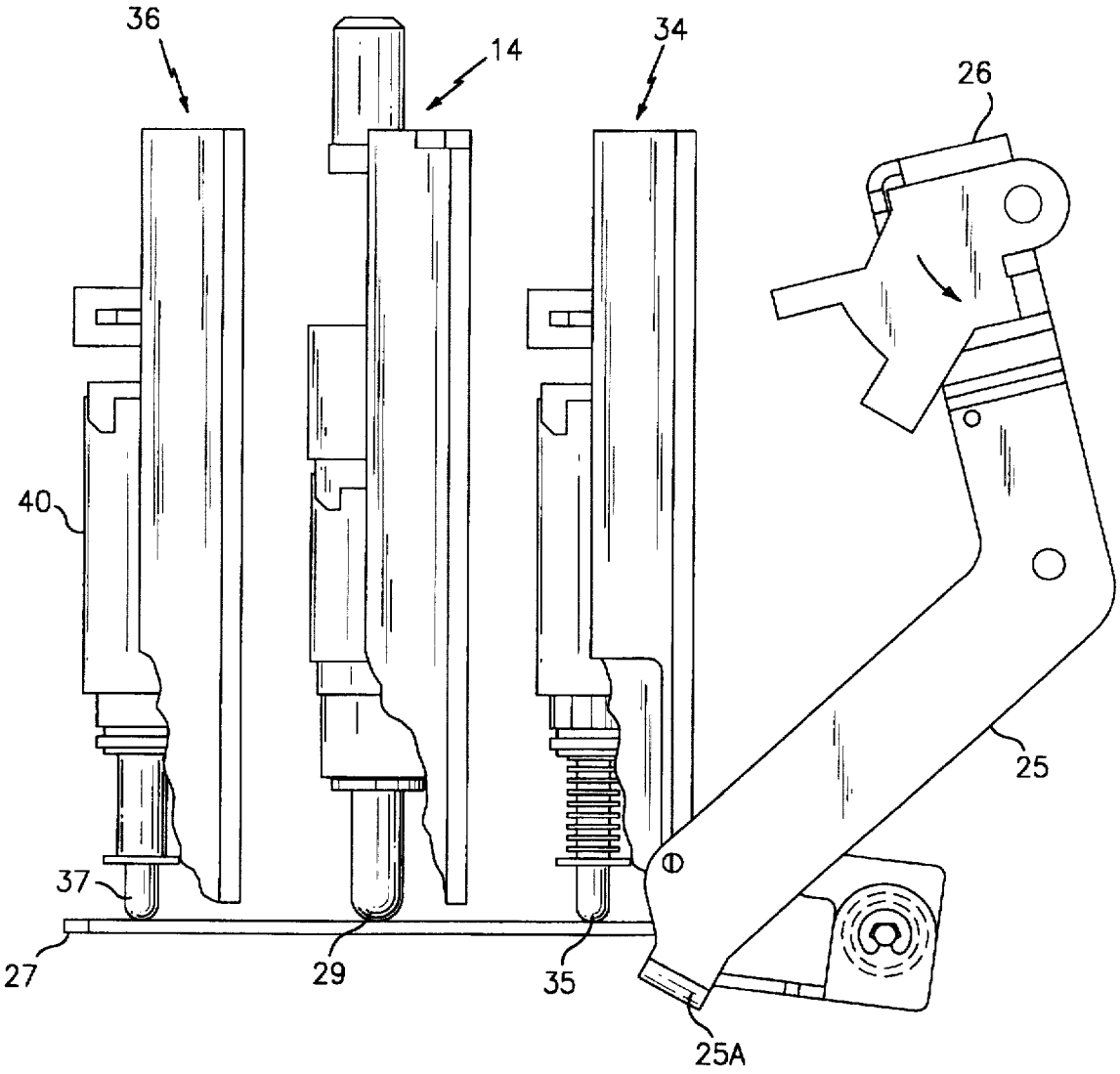
FIG. 3 is an accessories and lock-out mechanism according to the invention prior to contact separation.

FIG. 3 depicts the bell alarm-lockout accessory 14 and the undervoltage release accessory 34 described earlier in combination with the shunt trip lockout unit 36 in accordance with the invention. The shunt trip lockout unit includes a lockout solenoid 40 and plunger 37 that abuts against the accessory lever 27. The plungers 29, 35 of the bell alarm lockout accessory 14 and the undervoltage release accessory 34 also abut against the accessory lever 27. The above three accessories are all shown in an inactivated (non-lockout) state. In this state, accessory lever 27 does not block tab 25A and thus interlock lever 25. Therefore, U-shaped piece 26 may rotate and allows the CLOSE button 24 to move and thus allows closure of the breaker.

Figure 4:
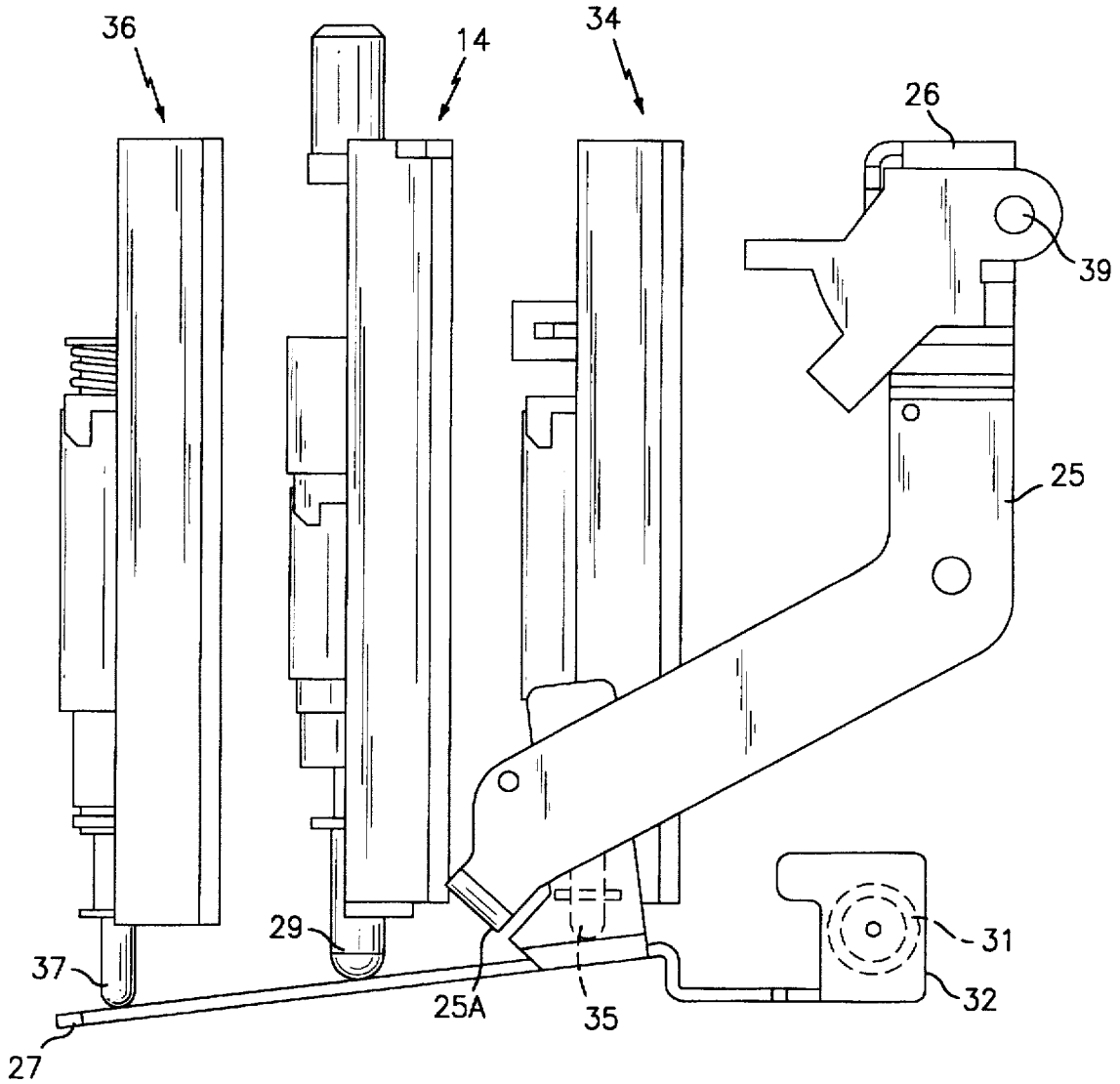
FIG. 4 is an enlarged top perspective view of an accessories and lock-out mechanism of FIG. 3 after contact separation.

FIG. 4 shows how the shunt trip lockout unit 36 responds to release the plunger 37 immediately upon application of the signal voltage to the shunt trip lockout unit. The plungers 29, 35 associated with the bell alarm lockout accessory 14 and undervoltage release accessory 34 perform in the manner described in other patents. The position of accessory lever 27 relative to tab 25A on the interlock lever 25 when a voltage signal is applied to the shunt trip lockout unit prevents clockwise rotation of the U-shaped piece 26 about the pivot pin 39 against the return bias of the torsion return spring 31 carried on the spring support 32. The breaker is in a lockout state. When an attempt is made to close the circuit breaker in this state, contact closing is prevented because U-shaped piece 26 and CLOSE button 24 of FIG. 1 are blocked until the signal voltage is removed from the shunt trip lockout unit 36 and plunger 37 returns to home positions, allowing breaker closure. This is accomplished when accessory lever 27 rotates back to the position indicated in FIG. 3 under the urgence of the torsion return spring 31, and thus tab 25A and interlock lever 25 are no longer blocked and U-shaped piece 26 and CLOSE button 24 are free to move. The plunger 37 is spring loaded to a return position within the solenoid to immediately return therein when the signal voltage to the solenoid is removed.

A circuit breaker interlock arrangement is described whereby a shunt trip lock-out solenoid supplements the bell alarm-lock out and undervoltage release accessories to rotate the accessory lever to prevent the circuit breaker closing until the shunt trip lockout unit is de-energized.

We claim:

1. An industrial-rated circuit breaker for high level overcurrent protection comprising:

an insulative base and an insulative cover;

an operating mechanism in said base controlled by an electronic trip unit arranged within said cover to open and close a pair of contacts;

a pair of opening and closing buttons interacting with said operating mechanism to open and close said contacts independent from said electronic trip unit;

a shunt trip accessory connecting with said electronic trip unit for actuating said electronic trip unit to separate said contacts upon receipt of a shunt trip voltage signal;

an accessory lever within said cover interacting with said closing button to prevent said closing button from closing said contacts; and a shunt trip lock-out solenoid electrically connecting with said shunt trip accessory and interacting with said accessory lever to prevent said closing button from closing said contacts until said shunt trip voltage signal is turned off.

2. The industrial-rated circuit breaker of claim 1 including a return spring biasing said accessory lever to a home position to allow depression of said closing button to close said circuit breaker contacts.

3. The industrial-rated circuit breaker of claim 1 including an interlock lever connecting between said accessory lever and said closing button, said interlock lever including an interlock tab interfacing with said accessory lever to prevent rotation of said interlock lever when said tab contacts said accessory lever and allow rotation of said interlock lever when said tab is out of contact with said accessory lever.

4. The industrial-rated circuit breaker of claim 3 including a U-shaped piece extending from an end of said interlock lever opposite from said interlock tab.

5. The industrial-rated circuit breaker of claim 1 wherein said shunt trip lockout solenoid includes a plunger contacting said accessory lever when said shunt trip accessory has instructed said electronic trip unit to separate said contacts and depressing said accessory lever against the return bias of said return spring.

6. The industrial-rated circuit breaker of claim 5 wherein said shunt trip accessory is electrically connected in parallel with said shunt trip lockout solenoid whereby interruption of said voltage signal turns off said lockout solenoid to allow said plunger to move away from said accessory lever.

7. The industrial-rated circuit breaker of claim 1 including a bell alarm-lockout unit interacting with said accessory lever to prevent rotation of said accessory lever when said bell alarm-lockout unit is actuated.

8. The industrial-rated circuit breaker of claim 1 including an undervoltage release unit interacting with said accessory lever to prevent rotation of said accessory lever when said undervoltage release unit is actuated.

9. A circuit breaker interlock device comprising in combination:

a shunt trip accessory adapted for connecting with a circuit breaker trip unit for actuating said trip unit to separate a pair of contacts within a circuit breaker upon receipt of a shunt trip voltage signal;

a shunt trip lock-out solenoid electrically connecting with said shunt trip accessory and interacting with an accessory lever within said circuit breaker to prevent a closing button from closing said circuit breaker contacts until said shunt trip voltage signal is turned off.

10. The circuit breaker interlock device of claim 9 wherein said shunt trip lock-out solenoid includes a plunger contacting said accessory lever when said shunt trip accessory has instructed said trip unit to separate said contacts and depressing said accessory lever against the return bias of an accessory lever return spring, said return spring biasing said accessory lever to a home position to allow depression of the circuit breaker closing button to close the circuit breaker contacts.

11. The industrial-rated circuit breaker of claim 10 wherein said plunger is spring-loaded to a home position within said shunt trip lockout solenoid whereby removal of said shunt trip voltage signal returns said plunger to said home position.

12. The industrial-rated circuit breaker of claim 11 wherein said shunt trip accessory is electrically connected with said lockout solenoid whereby interruption of said shunt trip voltage signal turns off said lockout solenoid to allow said plunger to move away from the accessory lever.

* * * * *

UNITED STATES PATENT AND TRADEMARK OFFICE

CERTIFICATE OF CORRECTION

PATENT NO. : 5,784,243

DATED : July 21, 1998

INVENTOR(S) : John A. Pollman et al

It is certified that error appears in the above-identified patent and that said Letters Patent is hereby corrected as shown below:

On the title page item 54

In the title, "LOOK-OUT" should read --LOCK-OUT--.

Signed and Sealed this

Twenty-fifth Day of May, 1999

*Attest:*

Q. TODD DICKINSON

*Attesting Officer*

*Acting Commissioner of Patents and Trademarks*